US009604809B2

(12) United States Patent
Lin

(10) Patent No.: US 9,604,809 B2
(45) Date of Patent: Mar. 28, 2017

(54) FILM ROLL/BAG-ON-A-ROLL MAKING MACHINE

(71) Applicant: COSMO MACHINERY CO., LTD., New Taipei (TW)

(72) Inventor: Chun Liang Lin, New Taipei (TW)

(73) Assignee: COSMO MACHINERY CO., LTD., New Taipei (TW)

( * ) Notice: Subject to any disclaimer, the term of this patent is extended or adjusted under 35 U.S.C. 154(b) by 115 days.

(21) Appl. No.: 14/665,895

(22) Filed: Mar. 23, 2015

(65) Prior Publication Data

US 2016/0280491 A1 Sep. 29, 2016

(51) Int. Cl.

| | |
|---|---|
| ***B65H 19/26*** | (2006.01) |
| ***B65H 19/22*** | (2006.01) |
| ***B65H 23/08*** | (2006.01) |

(52) U.S. Cl.

CPC ..... *B65H 19/26* (2013.01); *B65H 19/2238* (2013.01); *B65H 23/085* (2013.01); *B65H 2301/41346* (2013.01); *B65H 2301/5151* (2013.01); *B65H 2408/231* (2013.01); *B65H 2511/12* (2013.01); *B65H 2701/191* (2013.01)

(58) Field of Classification Search

CPC ..... B65H 19/2223; B65H 19/1868; B65H 2402/352

USPC ..... 242/533.5, 555.5, 599.2

See application file for complete search history.

(56) References Cited

U.S. PATENT DOCUMENTS

| | | | | |
|---|---|---|---|---|
| 2,769,600 A * | 11/1956 | Nystrand | B65H 19/2223 | 242/524.1 |
| 3,529,785 A * | 9/1970 | Mistele | B65H 19/2215 | 242/523.1 |
| 4,327,876 A * | 5/1982 | Kuhn | B65H 19/2223 | 242/527.4 |
| 8,201,768 B2 * | 6/2012 | Altesellmeier | B65H 18/26 | 242/533.4 |

* cited by examiner

*Primary Examiner* — Sang Kim

(74) *Attorney, Agent, or Firm* — Ming Chow; Sinorica, LLC

(57) ABSTRACT

A film roll/bags-on-a-roll making machine includes a feeding unit for transferring a film/sheet of bags, a reel displacement unit for cycling a reel through a reel let-off position, a reel-supplying position, a film-rolling position and a film-cutting position for enabling the reel to roll up the film/sheet of bags into a film roll/bags-on-a-roll, a cutting device for cutting off the feeding film/sheet of bags from the film roll/bags-on-a-roll at the reel that is cycled to the film-cutting position, and a control unit for controlling the operation of the feeding unit, the reel displacement unit and the cutting device.

14 Claims, 9 Drawing Sheets

FILM ROLL/BAG-ON-A-ROLL MAKING MACHINE

BACKGROUND OF THE INVENTION

1. Field of the Invention

The present invention relates to plastic film/sheet of bags packaging technology and more particularly, to a film roll/bags-on-a-roll making machine.

2. Description of the Related Art

Commercial plastic wraps are commonly provided in rolls and packed in individual boxes. Many film roll/bags-on-a-roll making machines are known for processing a plastic wrap into rolls. However, conventional film roll/bags-on-a-roll making machines are still not satisfactory in function and have drawbacks as follows:

1. These machines commonly use an electrical heating wire for cutting off the plastic wrap from each finished plastic wrap roll, resulting in generation of burning smell and traces of burnt.

2. Because the plastic wrap is a transparent, thin and collapsible film easy to get wrinkles, the user will be unable to easily pick up the leading edge of the plastic wrap roll.

3. These machines are commonly designed for use with reels of one single size for rolling up a plastic wrap into a roll, and thus, a different machine shall be used for rolling up a plastic wrap having a different width.

Therefore, it is desirable to provide a film roll/bags-on-a-roll making machine, which can improve the drawbacks of the conventional machines.

SUMMARY OF THE INVENTION

The present invention has been accomplished under the circumstances in view. It is therefore one object of the present invention to provide a film roll/bags-on-a-roll making machine, which can rapidly dispense a film/sheet of bags and process the film/sheet of bags into film rolls/bags-on-a-rolls.

To achieve this and other objects of the present invention, a film roll/bags-on-a-roll making machine comprises a feeding unit, a reel displacement unit, a cutting unit and a control unit. The feeding unit comprises a first sheet-transfer cylinder, a second sheet-transfer cylinder and a feeding unit power drive. The feeding unit power drive is controllable to rotate the second sheet-transfer cylinder in reversing the first sheet-transfer cylinder for transferring a film/sheet of bags through the gap between the first sheet-transfer cylinder and the second sheet-transfer cylinder. The reel displacement unit is disposed adjacent to the feeding unit, comprising a rotating shaft, a plurality of discs, a plurality of reel-holding devices, at least one reel-supplying rack and a reel displacement unit power drive. The discs are fixedly mounted on the rotating shaft, and spaced along the length of the rotating shaft. The reel-holding devices are equiangularly mounted between two discs for cycling through a reel let-off position, a reel-supplying position, a film-rolling position and a film-cutting position upon rotation of the discs with the rotating shaft. Each reel-holding device comprises a first reel-holding member mounted at one disc, and a second reel-holding member movably mounted at another disc to face toward the first reel-holding member for detachably holding a reel between the first reel-holding member and the second reel-holding member. The at least one reel-supplying rack is adapted to receive a reel and to provide the received reel to one reel-holding device in the reel-supplying position in such a manner that when one reel-holding device is cycled to the film-rolling position, the first sheet-transfer cylinder of the feeding unit is attached to the reel in the reel-holding device that reaches the reel-supplying position, allowing the reel to roll up the film/sheet of bags from the feeding unit. The reel displacement unit power drive is controllable to rotate the rotating shaft and the discs in cycling each loaded reel through the reel let-off position, the reel-supplying position, the film-rolling position and the film-cutting position. The cutting device is disposed adjacent to the reel displacement unit, and adapted for cutting off the feeding film/sheet of bags from one reel that is cycled with the respective reel-holding device to the film-cutting position. The control unit is electrically coupled with the feeding unit, the reel displacement unit and the cutting device, and adapted for controlling the movement of the reel-holding devices of the reel displacement unit to cycle each reel through the reel let-off position, the reel-supplying position, the film-rolling position and the film-cutting position.

When cycled to the let-off position, the first reel-holding member and the second reel-holding member are in an empty condition. Further, reels are arranged in a stack, and can be individually discharged onto the reel-supplying rack when the reel displacement unit is cycled to the reel-supplying position to face toward the reel-supplying rack. The second reel-holding member is elastically movable relative to the first reel-holding member so that one end of the reel can be secured to the first reel-holding member and the opposite end of the reel can be detachably secured to the second reel-holding member. After the supply of one reel to the reel displacement unit, the reel is carried to a next step position, and a next reel-holding device that is in a vacant condition is cycled to the reel-supplying rack for receiving another reel. As soon as one reel is shifted from the film-rolling position to the film-cutting position, a part of the feeding film/sheet of bags is suspending between the reel and the feeding unit, and the serrated cutting blade is moved by the second pneumatic cylinder component to cut off the feeding film/sheet of bags. Immediately after cutting, the serrated cutting blade is moved back to its original position by the second pneumatic cylinder component. This cutting operation avoids the problem of generation of burning smell and traces of burnt of the prior art technique that uses an electric heating wire to cut off the film.

It is therefore one object of the present invention to provide a film roll/bags-on-a-roll making machine, which can be adjusted to dispense a film/sheet of bags having a different width and to roll it into film rolls/bags-on-a-rolls.

To achieve this and other object of the present invention, each reel-holding device of the film roll/bags-on-a-roll making machine can be adjusted to hold a different length of reel for rolling up a film/sheet of bags having a different width.

It is therefore one object of the present invention to provide a film roll/bags-on-a-roll making machine, which enables the user to easily find and pick up the leading end of the film roll/bags-on-a-roll.

To achieve this and other object of the present invention, each reel-holding device of the film roll/bags-on-a-roll making machine further comprises a smoothing unit. The smoothing unit comprises a smoothing unit pneumatic cylinder, a roller holder frame, a smoothing roller and a smoothing unit power drive. The roller holder frame is connected to the smoothing unit pneumatic cylinder. The smoothing unit power drive is coupled with the smoothing roller. The smoothing roller is rotatably mounted in the roller holder frame. The smoothing unit pneumatic cylinder is controllable to move the roller holder frame and the smoothing roller into contact with a finished film roll/bags-on-a-roll at one reel for enabling the smoothing roller to be rotated by the smoothing unit power drive to smooth the edge of the finished film roll/bags-on-a-roll at the respective reel. Further, the control unit is controllable to drive smoothing unit power drive to rotate the smoothing roller in a direction reverse to the winding direction of the film/sheet of bags being wound round each reel into a film roll/bags-on-a-roll, causing the edge of the finished film roll/bags-on-a-roll at the respective reel to be folded up so that the user can easily find and pick up the folded leading end of the film roll/bags-on-a-roll.

DETAILED DESCRIPTION OF THE PREFERRED EMBODIMENT

Figure 1:
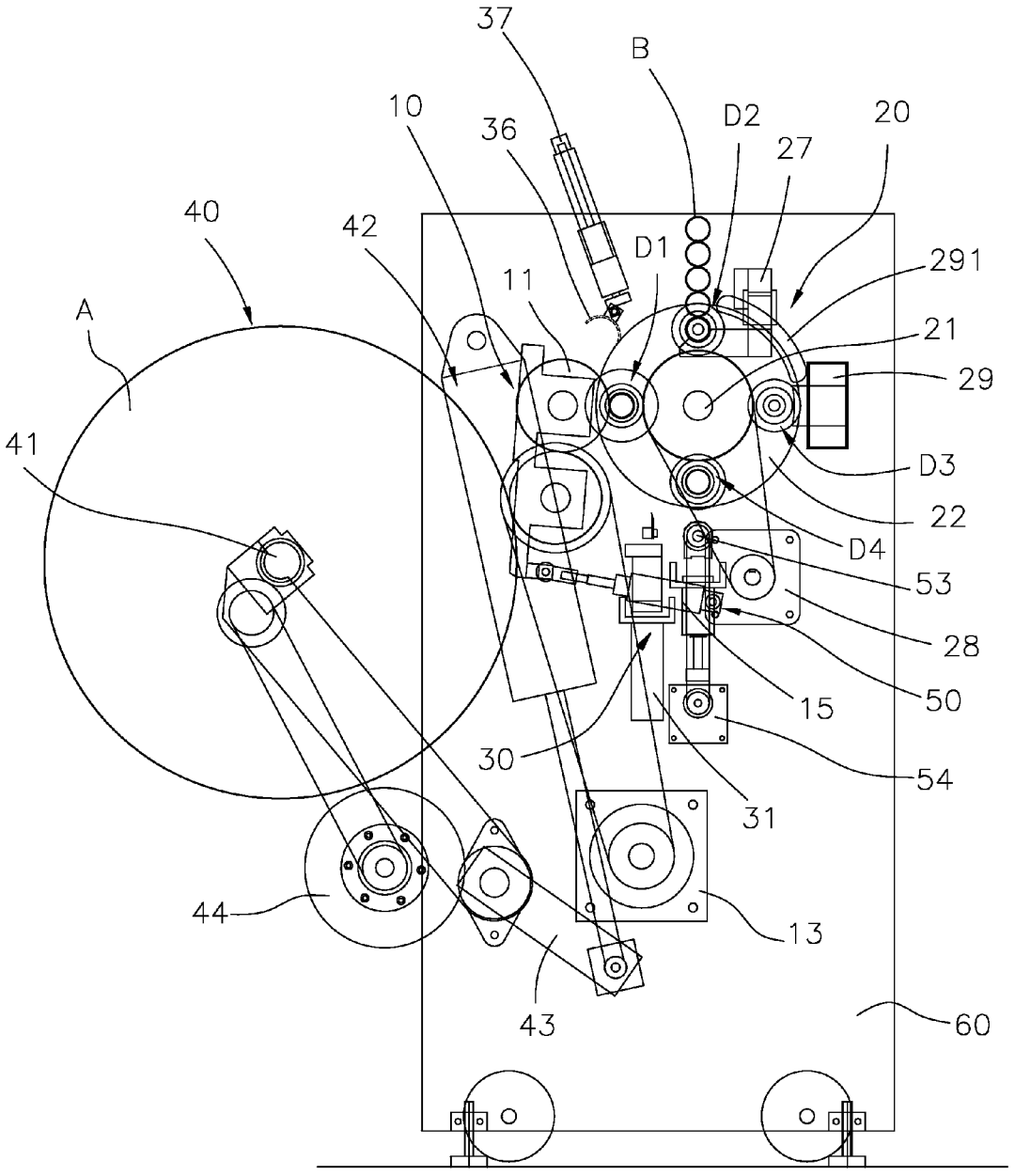
FIG. 1 is schematic side view of a film roll/bags-on-a-roll making machine in accordance with the present invention.
Figure 2:
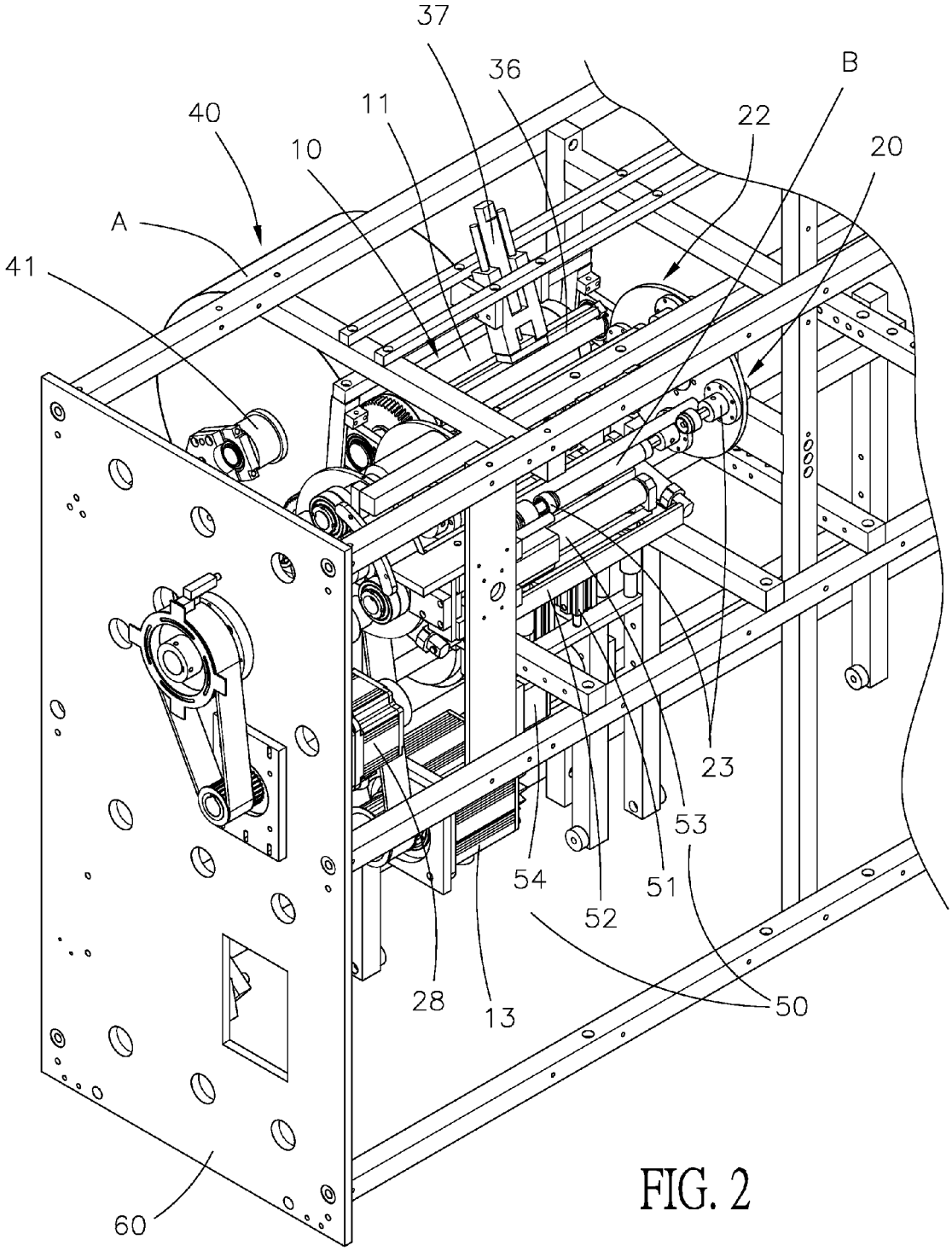
FIG. 2 is an oblique top elevational view of the film roll/bags-on-a-roll making machine in accordance with the present invention.
Figure 3:
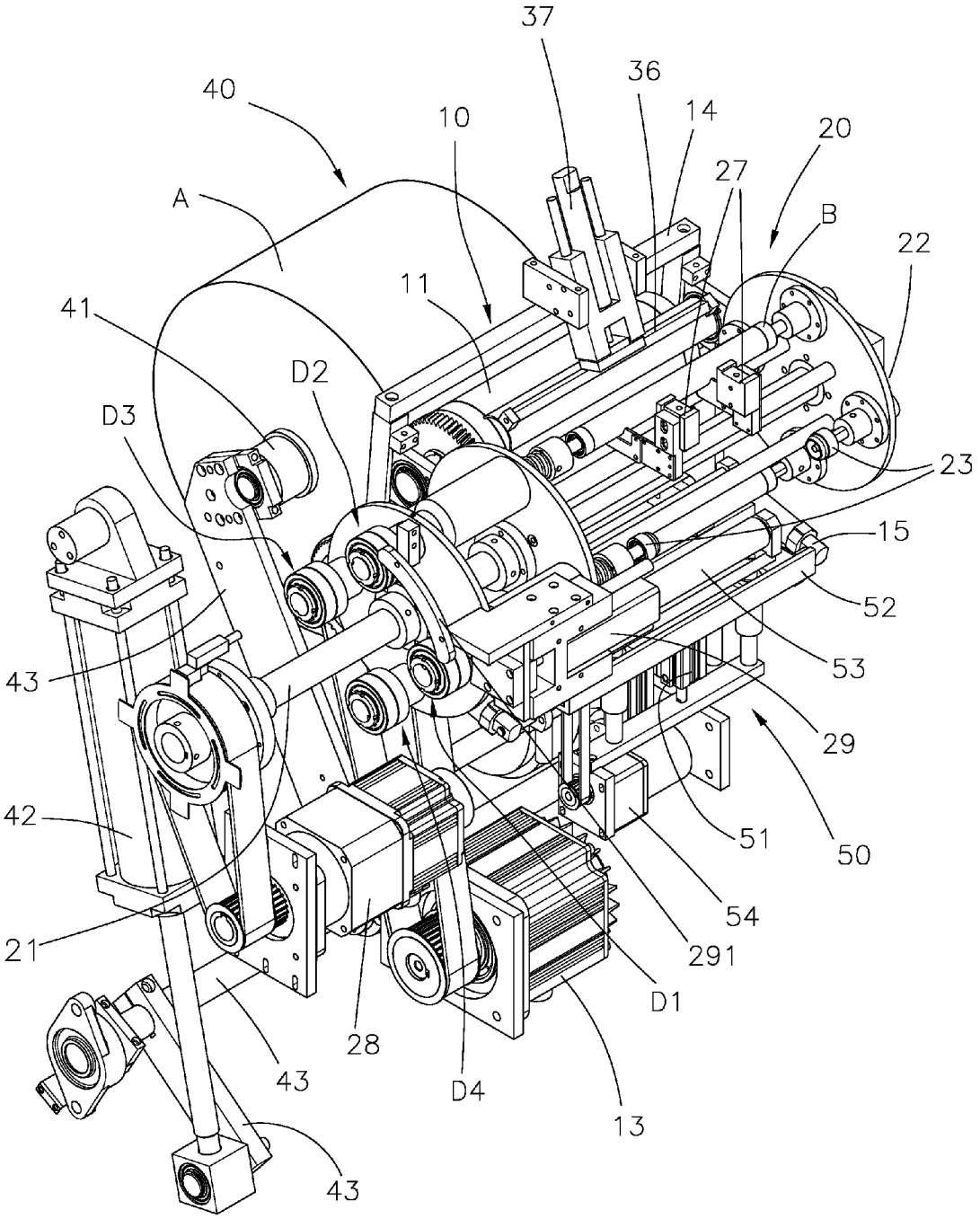
FIG. 3 corresponds to FIG. 2, illustrating the internal structural arrangement of the film roll/bags-on-a-roll making machine after removal of the machine base.
Figure 4:
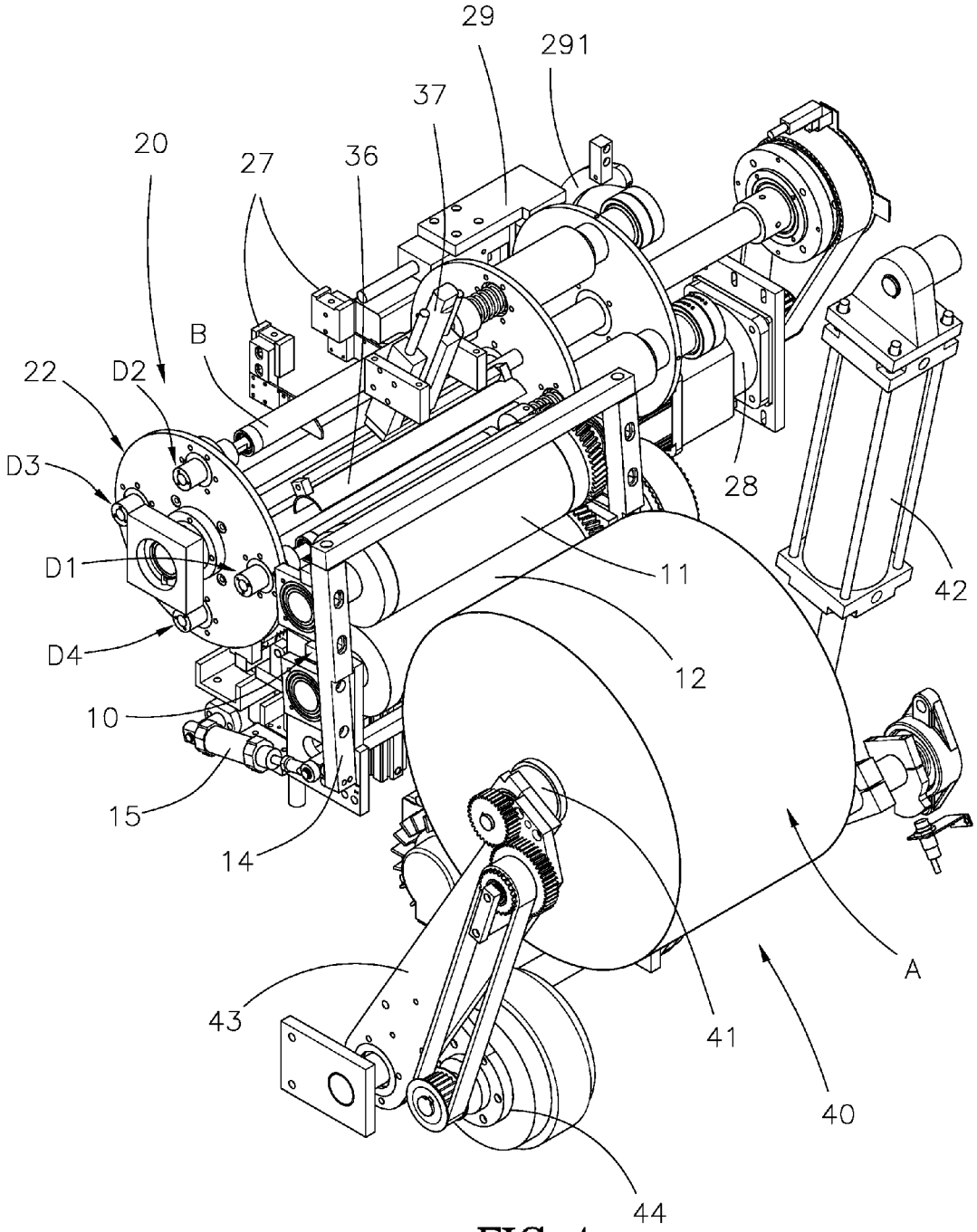
FIG. 4 corresponds to FIG. 4 when viewed from another angle.
Figure 5:
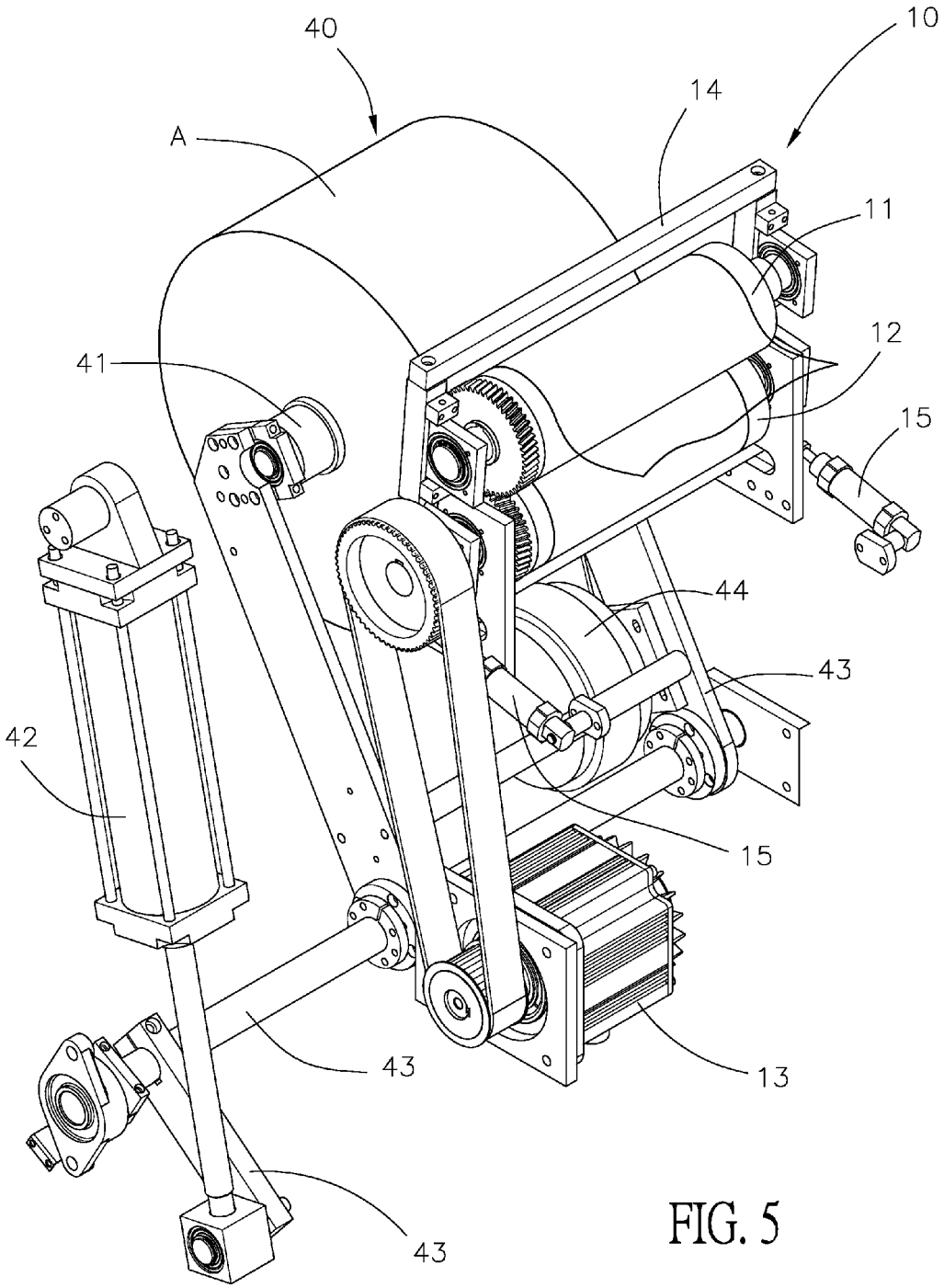
FIG. 5 is an oblique top elevational view of a part of the present invention, illustrating the structural arrangement of the feeding unit and the material loading unit.

Referring to FIGS. 1-7, a film roll/bags-on-a-roll making machine in accordance with the present invention comprises a feeding unit 10, reel displacement unit 20, reel-holding device 23, cutting device 30, and a control unit (not shown).

The feeding unit 10 comprises a first sheet-transfer cylinder 11, a second sheet-transfer cylinder 12, and a feeding unit power drive 13. The feeding unit power drive 13 is controllable to rotate the second sheet-transfer cylinder 12, causing the second sheet-transfer cylinder 12 to reverse the first sheet-transfer cylinder 11 so that a film/sheet of bags A can be transferred through the gap between the first sheet-transfer cylinder 11 and the second sheet-transfer cylinder 12 for the implementation of further processing steps. In this embodiment, the film/sheet of bags A is a plastic wrap.

The reel displacement unit 20 is disposed adjacent to the feeding unit 10, comprising a rotating shaft 21, a plurality of discs 22, a plurality of reel-holding devices 23 for holding reels B, and at least one reel-supplying rack 27, and a reel displacement unit power drive 28. The discs 22 are mounted on the rotating shaft 21, and spaced along the length of the rotating shaft 21. The reel-holding devices 23 are equiangularly mounted at two opposing discs 22 for holding reels B between the two opposing discs 22, and moved with the rotation of the discs 22 to cycle through a series of positions wherein the step position D1 is the reel let-off position; the step position D2 is the reel-supplying position; the step position D3 is the film-rolling position; the step position D4 is the film-cutting position.

The reel-holding devices 23 are identical, each comprising a first reel-holding member 231 and a second reel-holding member 232. The first reel-holding member 231 is mounted at one disc 22. The second reel-holding member 232 is a spring-loaded reel-holding member mounted at another disc 22 to face toward the first reel-holding member 231, and can be elastically moved in direction toward or away from the first reel-holding member 231 within a limited distance for allowing loading of a reel B between the first reel-holding member 231 and the second reel-holding member 232. The reel-supplying rack 27 is located in the reel-supplying position D2 for receiving a reel B and then supplying the reel B to the reel-holding device 23 that is moved to the reel-supplying position D2. When one reel-holding device 23 is cycled to the film-rolling position D3, the first sheet-transfer cylinder 11 of the feeding unit 10 is attached to the reel B in the reel-holding device 23 that reaches the reel-supplying position D2, allowing the reel B to roll up the film/sheet of bags A from the feeding unit 10. The reel displacement unit power drive 28 is adapted for rotating the rotating shaft 21 and the discs 22, cycling each loaded reel B to every step position.

The cutting device 30 is disposed adjacent to the reel displacement unit 20. After the reel B in one reel-holding device 23 rolled up a predetermined length of the feeding film/sheet of bags A into a roll, the reel B is cycled with the respective reel-holding device 23 to the film-cutting position D4 where the cutting device 30 is controlled to cut off the feeding film/sheet of bags A, and then, the reel B is cycled with the respective reel-holding device 23 to the reel let-off position D1.

The control unit (not shown) is electrically coupled with the feeding unit 10, the reel displacement unit 20 and the cutting device 30, and adapted for controlling the movement of the reel-holding devices 23 of the reel displacement unit 20 to cycle each loaded reel B through the aforesaid step positions D1~D4. Actually, the control unit is electrically coupled with the feeding unit power drive 13, the reel displacement unit power drive 28 and the cutting device 30. Subject to the instruction of the control unit, the feeding film/sheet of bags B, for example, plastic wrap, is moved by the feeding unit 10 to the reel B in the replacement unit 20 that is cycled to the step D2, enabling the leading end of the film/sheet of bags B to be attached to the reel B. At this time, the reel displacement unit power drive 28 is controlled to rotate the discs 22 to the step position D3, enabling the reel B to be rotated to roll up a predetermined length of the feeding film/sheet of bags B. When the discs 22 are rotated, the reel-holding devices 23 are shifted from one step position to another. Thus, each reel B can be moved with the respective reel-holding device 23 to cycle through the reel-supplying position D2, the film-rolling position D3, the film-cutting position D4 and the reel let-off position D1 step by step in a proper order.

When cycled to the let-off position D1, the first reel-holding member 231 and the second reel-holding member 232 are in an empty condition. In actual application, reels B are arranged in a stack, and can be individually discharged onto the reel-supplying rack 27 when the reel displacement unit 20 is cycled to the reel-supplying position D2 to face toward the reel-supplying rack 27. As stated above, the second reel-holding member 232 is elastically movable relative to the first reel-holding member 231 so that one end of the reel B can be secured to the first reel-holding member 231 and the opposite end of the reel B can be detachably secured to the second reel-holding member 232. After the supply of one reel B to the reel displacement unit 20, the reel B is carried to a next step position, and a next reel-holding device 23 that is in a vacant condition is cycled to the reel-supplying rack 27 for receiving another reel B.

When one reel B reaches the film-rolling position D3, the feeding film/sheet of bags A is being continuously transferred through the gap between the first sheet-transfer cylinder 11 and the second sheet-transfer cylinder 12, enabling the leading end of the film/sheet of bags A to be attached to the reel B. At this time, the first sheet-transfer cylinder 11 of the feeding unit 10 is pressed on the reel B, the film/sheet of bags A and the second sheet-transfer cylinder 12. During the operation of the feeding unit power drive 13 to rotate the second sheet-transfer cylinder 12 in reversing the first sheet-transfer cylinder 11, the reel B by the first sheet-transfer cylinder 11 relative to the respective reel-holding device 23 to roll up the feeding film/sheet of bags A from the feeding unit 10.

Figure 7:
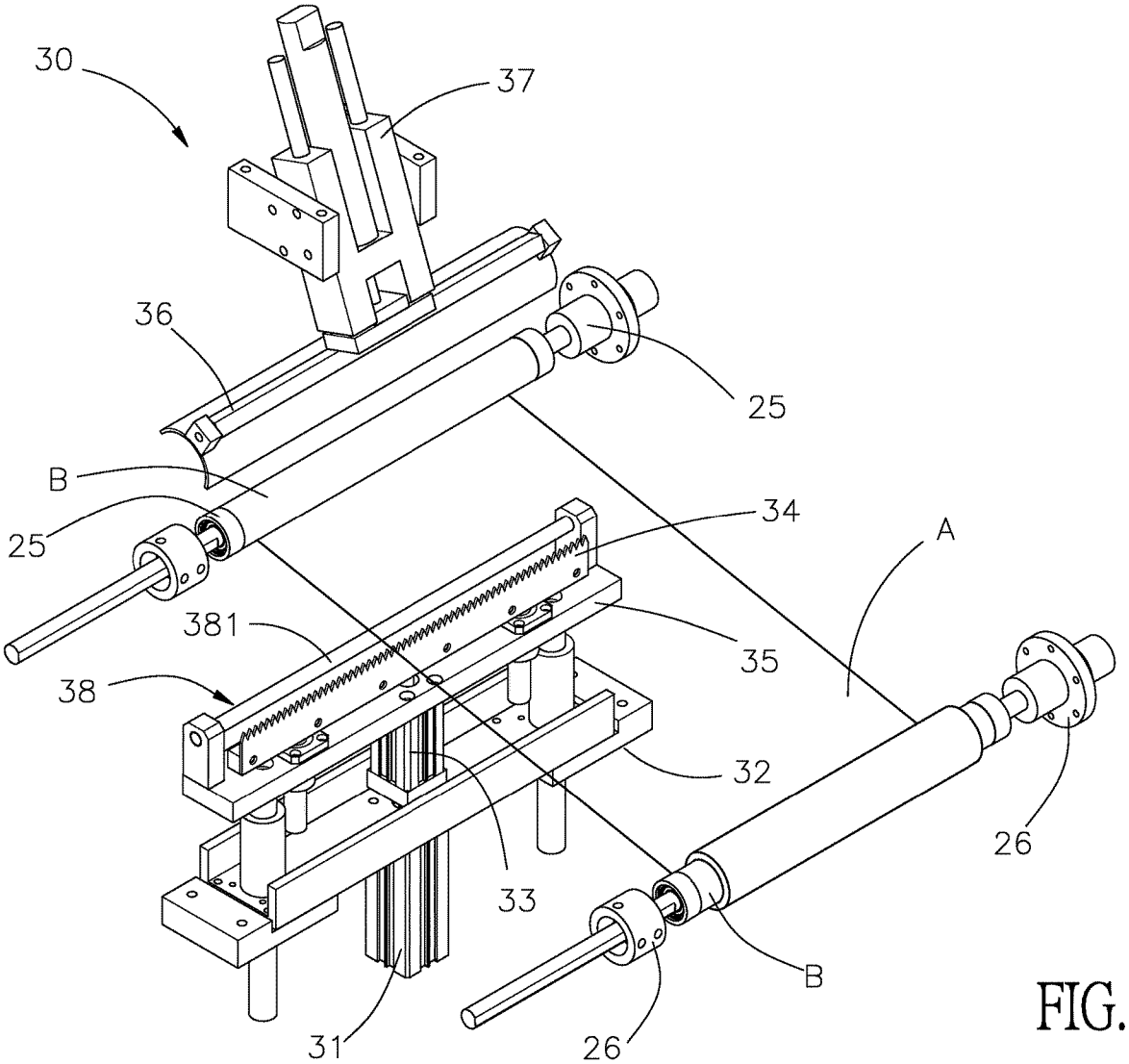
FIG. 7 is a schematic applied view of the present invention, illustrating the cutting operation of the cutting device.

When the reel B is shifted from the film-rolling position D3 to the film-cutting position D4, as shown in FIG. 7, a part of the feeding film/sheet of bags A is suspending between the reel B and the feeding unit 10. At this time, a first pneumatic cylinder component 31 of the cutting device 30 is driven to move a second pneumatic cylinder component 33 and a serrated cutting blade 34 upwardly to the film/sheet of bags A for performing the cutting process.

After the cutting operation, the reel B is shifted from the film-cutting position D4 to the reel let-off position D1, where the second reel-holding member 232 of the reel-holding device 23 is retracted from one end of the reel B, enabling the reel B to fall from the reel displacement unit 20, and the reel-holding device 23 can then be shifted from the reel let-off position D1 to the reel-supplying position D2. Thus, the reel-supplying step, the film-rolling step, the film-cutting step and the reel let-off step are continuously and automatically cycled enhancing quick fabrication of rolls of film/sheet of bags.

When the reel B is shifted from the film-rolling position D3 to the film-cutting position D4, a part of the feeding film/sheet of bags A is suspending between the reel B and the feeding unit 10, and the serrated cutting blade 34 is moved by the second pneumatic cylinder component 33 to cut off the feeding film/sheet of bags A. Immediately after cutting, the serrated cutting blade 34 is moved back to its original position by the second pneumatic cylinder component 33. This cutting operation avoids the problem of generation of burning smell and traces of burnt of the prior art technique that uses an electric heating wire to cut off the film.

Referring to FIGS. 1-5, the film roll/bags-on-a-roll making machine of the present invention further comprises a material loading unit 40. The material loading unit comprises an axle 41, a pneumatic cylinder 42, a plurality of links 43, and a brake 44. The pneumatic cylinder 42 is adapted for moving the links 43. The axle 41 is adapted for holding a film/sheet of bags A. The links 43 are coupled to the axle 41, and adapted for moving the film/sheet of bags A toward or away from the feeding unit 10. When the film/sheet of bags A is moved away from the feeding unit 10, the leading end of the film/sheet of bags A is inserted in between the second sheet-transfer cylinder 12 and the first sheet-transfer cylinder 11. The brake 44 is coupled to the axle 41, and adapted to buffer the revolving speed of the axle 41 in delivering the film/sheet of bags A. Thus, the transferring speed of the film/sheet of bags A in the material loading unit 40 is slower than the transferring speed of the film/sheet of bags A in the feeding unit 10 and the revolving speed of the reel B, and thus, the film/sheet of bags A is kept at a predetermined tension.

The first sheet-transfer cylinder 11 of the feeding unit 10 is selected from rubber or other material with a high friction coefficient. Thus, when the first sheet-transfer cylinder 11 is pressed on the film/sheet of bags A at the reel B, a certain friction force is produced, enabling the first sheet-transfer cylinder 11 to rotate the reel B. The feeding unit 10 further comprises bracket 14 and two drive members 15. The bracket 14 is adapted to hold the first sheet-transfer cylinder 11 and the second sheet-transfer cylinder 12. The feeding unit power drive 13 (for example, motor) is controllable to rotate the second sheet-transfer cylinder 12, causing the second sheet-transfer cylinder 12 to reverse the first sheet-transfer cylinder 11 by gear transmission. The first sheet-transfer cylinder 11 is moved into contact with the reel B, the reel B is rotated by the first sheet-transfer cylinder 11. The drive members 15 can be, for example, pneumatic cylinders adapted for biasing the bracket 14, moving the first sheet-transfer cylinder 11 into contact with or away from the reel B in the respective reel-holding device 25.

Figure 6:
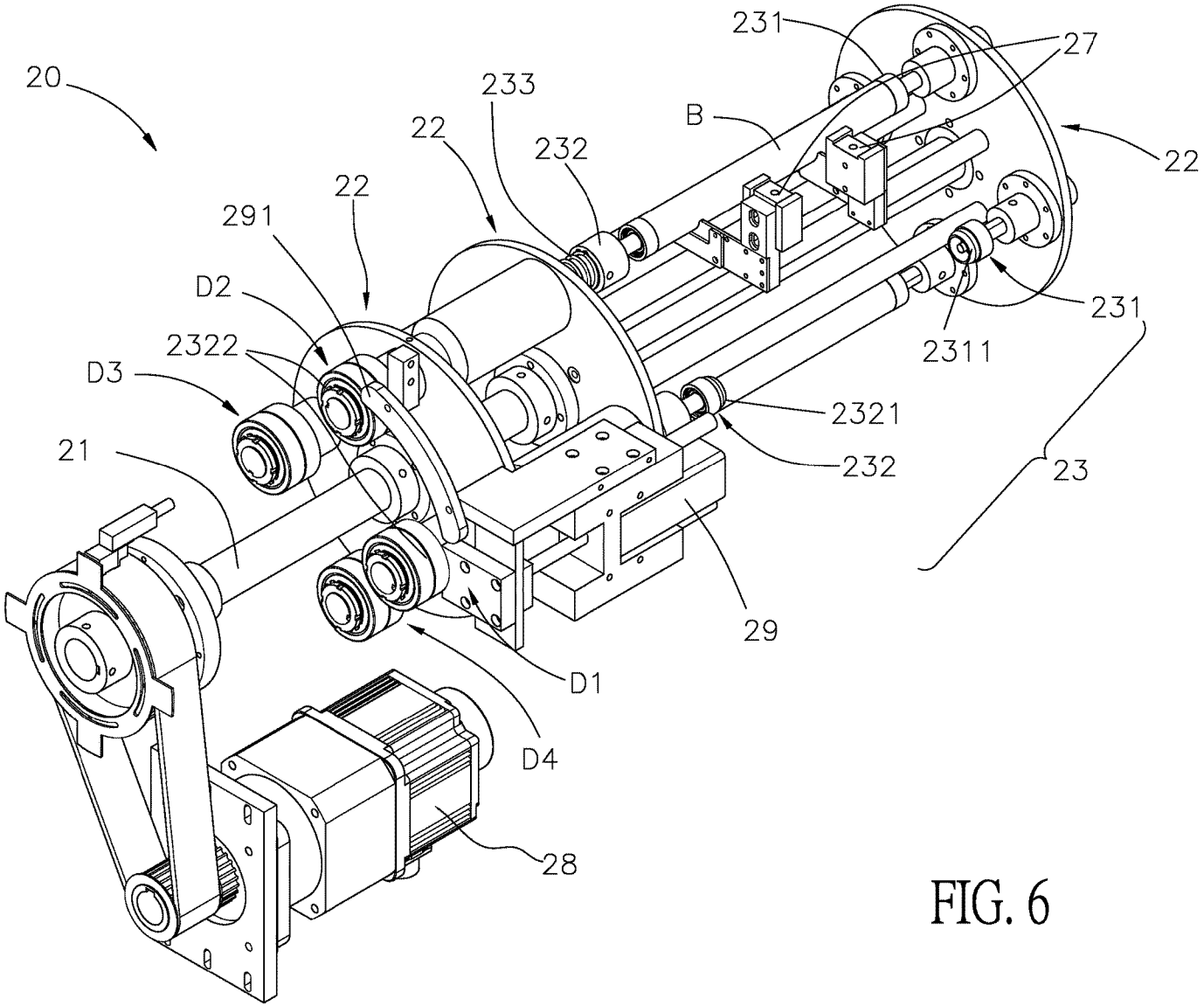
FIG. 6 is an oblique top elevational view of a part of the present invention, illustrating the structural arrangement of the reel displacement unit.
Figure 9:
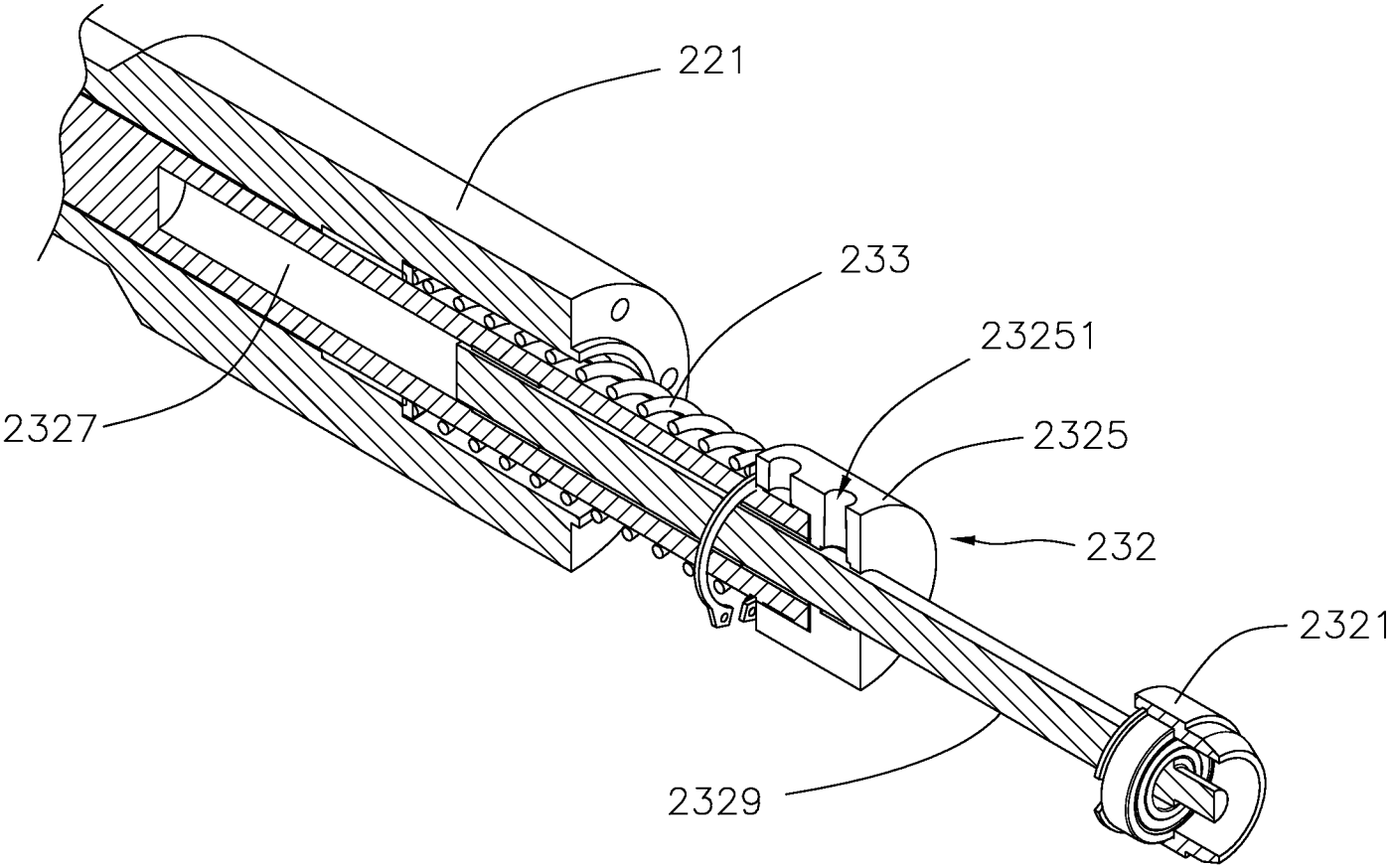
FIG. 9 is a sectional elevational view of a part of the present invention, illustrating the relationship between the second reel-holding member of the reel-holding device and the respective holder tube.

Referring to FIG. 6 and FIG. 9, in one embodiment of the present invention, the second reel-holding member 232 of each reel-holding device 23 of the reel displacement unit 20 is loaded with an elastic member, for example, spring 233. The reel displacement unit 20 further comprises a plurality of holder tubes 221 equiangularly located at the disc 22 that holds the second reel-holding members 232 of the reel-holding devices 23. Each second reel-holding member 232 is supported on the associating spring 233 in one respective holder tube 221 and axially slidable coupled to the respective holder tube 221. Thus, the second reel-holding member 232 is movably coupled to the respective disc 20 for holding one end of one respective reel B.

The first reel-holding member 231 of each reel-holding device 23 comprises a reel-holding end portion 2311. The second reel-holding member 232 of each reel-holding device 23 comprises a reel-holding end portion 2321. The reel-holding end portions 2311 and 2321 are smaller than the inner diameter of each reel B so that they can be respectively inserted into the two opposite end of one reel B to hold the reel B therebetween in a rotatable manner. The second reel-holding member 232 of each reel-holding device 23 further comprises an adjustment block 2325, an axial hole 2327, and a pin 2329. The reel-holding end portion 2321 is located at one end of the pin 2329. The opposite end of the pin 2329 is inserted through the adjustment block 2325 into the inside of the axial hole 2327. The adjustment block 2325 comprises at least one radially extending screw hole 23251. The adjustment block 2325 is coupled to the pin 2329 between the reel-holding end portion 2321 and the respective holder tube 221 and stopped at one end of the respective spring 233 that has its other end stopped at an inside part of the respective holder tube 221, allowing the pin 2329 to be moved axially in and out of the axial hole 2327. A tightening-up screw (not shown) is threaded into one respective screw hole 23251 to lock the adjustment block 2325 to the pin 2329 in the axial hole 2327 at the desired position. When loosened each tightening-up screw, the pin 2329 is unlocked from the adjustment block 2325 and can be moved axially in and out of the axial hole 2327 to adjust the distance between the reel-holding end portion 2321 of the second reel-holding member 232 and the respective holder tube 221, thereby changing the distance between the first reel-holding member 231 and the associating second reel-holding member 232 according to the length of the reel B for rolling up a different width of film/sheet of bags A.

In one embodiment of the present invention, the reel displacement unit 20 further comprises a reel displacement unit pneumatic cylinder 29, a guide yoke 291, and a plurality of stop blocks 2322. The stop blocks 2322 are equiangularly mounted on a back side of one disc 22 and respectively linked to the respective second reel-holding members 232 and the respective holder tubes 221 corresponding to the respective step positions D1,D2,D3,D4. The guide yoke 291 is disposed between the step position D1 and the step position D2 at one lateral side relative to the stop blocks 2322. The stop blocks 2322 are movable with the respective second reel-holding members 232. The reel displacement unit pneumatic cylinder 29 is movable with the second reel-holding members 232 of the reel-holding devices 23 and the stop blocks 2322. When one second reel-holding member 232 is shifted to the reel let-off position D1, the control unit (not shown) drives the reel displacement unit pneumatic cylinder 29 to move the second reel-holding member 232 in direction toward the respective stop block 2322 to compress the associating spring 233, and at the same time, the respective stop block 2322 is moved in direction away from the disc 22 and stopped at one end of the guide yoke 291. At this time, the reel B carrying a film roll/bags-on-a-roll is released from the second reel-holding member 232. Thereafter, the respective reel-holding device 23 is shifted to the reel-supplying position D2, and the respective stop block 2322 is moved along the guide yoke 291 and then away from the guide yoke 291, enabling the reel-holding end portion 2321 of the respective second reel-holding member 232 to be moved by the elastic potential energy of the associating spring 233 back to its original position to hold one end of another reel B that is newly supplied by the reel-supplying rack 27 and attached with its other end to the first reel-holding member 231.

Referring to FIG. 7 and FIG. 1 again, in one embodiment of the present invention, the cutting device 30 comprises a cutting device first pneumatic cylinder component 31, a base frame 32, a cutting device second pneumatic cylinder component 33, and a serrated cutting blade 34. The cutting device first pneumatic cylinder component 31 is mounted in a bottom side of the base frame 32. The cutting device second pneumatic cylinder component 33 is upwardly inserted through the base frame 32 and coupled to the first pneumatic cylinder component 31. The serrated cutting blade 34 is mounted at the cutting device second pneumatic cylinder component 33. The cutting device 30 further comprises a cutter holder 35, a pressure cover 36, a pressure cover pneumatic cylinder 37, and a air sprayer 38. The cutter holder 35 is mounted on the cutting device second pneumatic cylinder component 33 to hold the serrated cutting blade 34. The air sprayer 38 is mounted at the cutter holder 35 adjacent to the serrated cutting blade 34, having a plurality of jet holes 381. The pressure cover 36 defines an arched inner wall 361. The pressure cover pneumatic cylinder 37 is controllable to move the pressure cover 36 downwardly onto the reel B in one reel-holding device 25 to hold down the film/sheet of bags A for cutting. Immediately after cutting, the control unit (not shown) drives the air sprayer 38 to send compressed air out of the jet holes 381 toward the feeding film/sheet of bags A, forcing the cutting end of the film/sheet of bags A out of the arched inner wall 361 of the pressure cover 36 onto the reel B in the next reel-holding device 25 for further rolling operation.

Figure 8:
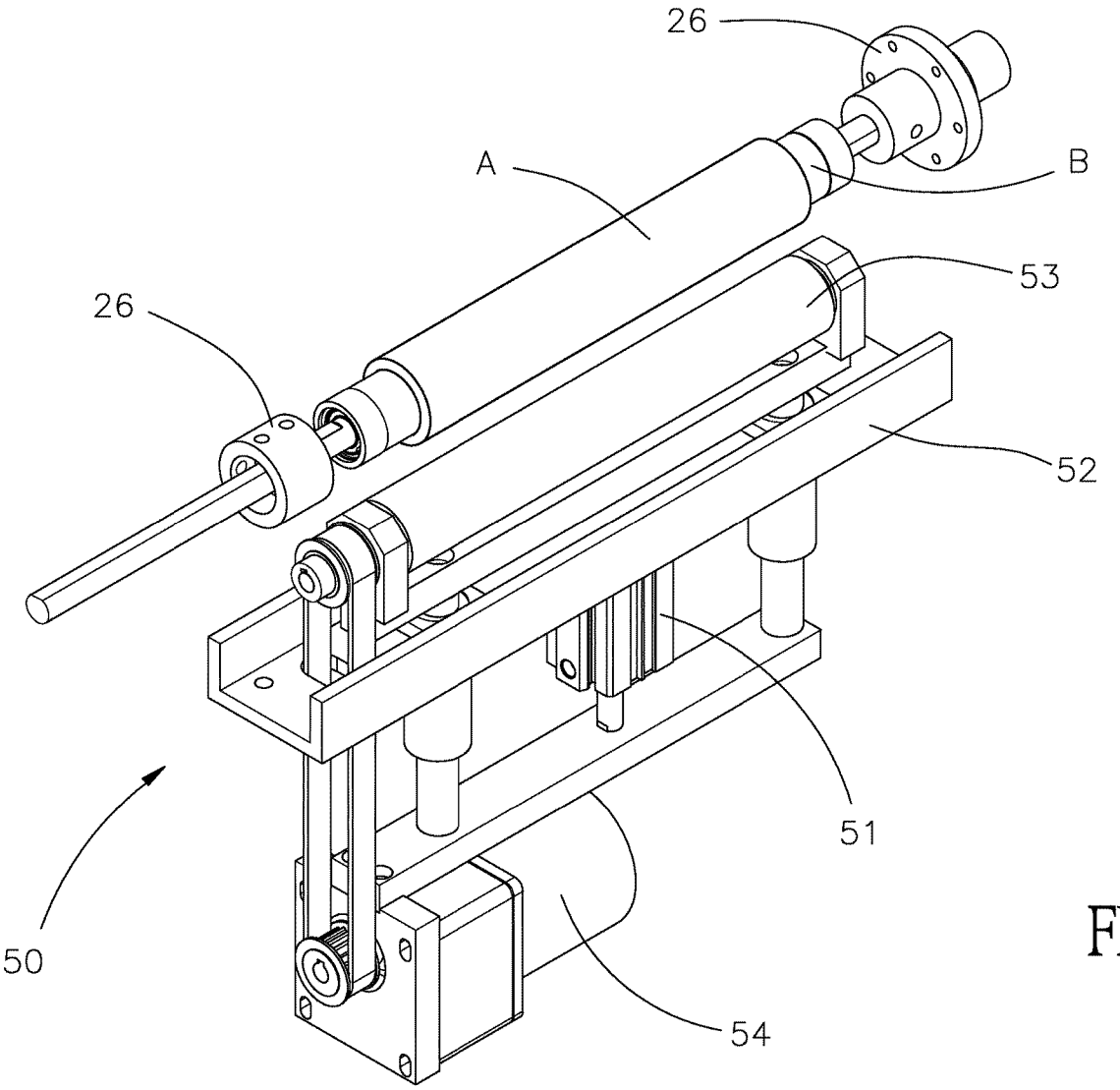
FIG. 8 is an oblique top elevational view of a part of the present invention, illustrating the structural arrangement of the smoothing unit.

Referring to FIG. 8 and FIG. 1 again, in one embodiment of the present invention, the film roll/bags-on-a-roll making machine further comprises a smoothing unit 50. The smoothing unit 50 comprises a smoothing unit pneumatic cylinder 51, a roller holder frame 52, a smoothing roller 53, and a smoothing unit power drive 54. The roller holder frame 52 is coupled to the smoothing unit pneumatic cylinder 51. The smoothing unit power drive 54 is coupled with the smoothing roller 53. The smoothing roller 53 is rotatably mounted in the roller holder frame 52. The smoothing unit pneumatic cylinder 51 is controllable to move the roller holder frame 52 and the smoothing roller 53 into contact with the film/sheet of bags A of the duly finished film roll/bags-on-a-roll at the respective reel B, enabling the smoothing roller 53 to be rotated by the smoothing unit power drive 54 to smooth the edge of the film/sheet of bags A of the duly finished film roll/bags-on-a-roll at the respective reel B.

Further, subject to the control of the control unit (not shown), the smoothing unit power drive 54 can rotate the smoothing roller 53 to smooth the edge of the film/sheet of bags A of the duly finished film roll/bags-on-a-roll at the respective reel B in a direction reverse to the winding direction of the film/sheet of bags A of the duly finished film roll/bags-on-a-roll around the respective reel B, causing the edge of the finished film roll/bags-on-a-roll at the respective reel B to be folded up so that the user can easily find and pick up the folded leading end of the film roll/bags-on-a-roll.

Further, the smoothing roller 53 is selected from rubber or other material with a high friction coefficient. Thus, when the smoothing roller 53 touches the film/sheet of bags A of the duly finished film roll/bags-on-a-roll at the respective reel B, a high friction force can be produced, enabling the edge of the film/sheet of bags A of the duly finished film roll/bags-on-a-roll at the respective reel B to be easily reversed.

Referring to FIGS. 1 and 2 again, the film roll/bags-on-a-roll making machine further comprises a machine base 60 adapted to hold the feeding unit 10, the reel displacement unit 20, the cutting device 30, the material loading unit 40 and the smoothing unit 50 steadily in place, facilitating implementing the reel-supplying, film-rolling position, film-cutting and reel let-off procedures.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A film roll/bags-on-a-roll making machine, comprising:

a feeding unit comprising a first sheet-transfer cylinder, a second sheet-transfer cylinder and a feeding unit power drive, said feeding unit power drive being controllable to rotate said second sheet-transfer cylinder in reversing said first sheet-transfer cylinder for transferring a film/sheet of bags through a gap between said first sheet-transfer cylinder and said second sheet-transfer cylinder;

a reel displacement unit disposed adjacent to said feeding unit, said reel displacement unit comprising a rotating shaft, a plurality of discs, a plurality of reel-holding devices, at least one reel-supplying rack and a reel displacement unit power drive, said discs being fixedly mounted on said rotating shaft and spaced along the length of said rotating shaft, said reel-holding devices being equiangularly mounted between two said discs for cycling through a reel let-off position, a reel-supplying position, a film-rolling position and a film-cutting position upon rotation of said discs with said rotating shaft, each said reel-holding device comprising a first reel-holding member mounted at one said disc and a second reel-holding member movably mounted at another said disc to face toward said first reel-holding member for detachably holding a reel between said first reel-holding member and said second reel-holding member, said at least one reel-supplying rack being adapted to receive a reel and to provide the received said reel to one said reel-holding device in said reel-supplying position in such a manner that when one said reel-holding device is cycled to said film-rolling position, said first sheet-transfer cylinder of said feeding unit is attached to said reel in said reel-holding device that reaches said reel-supplying position, allowing said reel to roll up said film/sheet of bags from said feeding unit, said reel displacement unit power drive being controllable to rotate said rotating shaft and said discs in cycling each loaded said reel through said reel let-off position, said reel-supplying position, said film-rolling position and said film-cutting position;

a cutting device disposed adjacent to said reel displacement unit and adapted for cutting off said feeding film/sheet of bags from one said reel that is cycled with the respective said reel-holding device to said film-cutting position; and a control unit electrically coupled with said feeding unit, said reel displacement unit and said cutting device, and adapted for controlling the movement of said reel-holding devices of said reel displacement unit to cycle each said reel through said reel let-off position, said reel-supplying position, said film-rolling position and said film-cutting position.

2. The film roll/bags-on-a-roll making machine as claimed in claim 1, further comprising a material loading unit, said material loading unit comprising an axle, a material loading unit pneumatic cylinder, a plurality of links and a brake, said material loading unit pneumatic cylinder being controllable to move said links, said axle being adapted for holding said film/sheet of bags and supplying said film/sheet of bags to said feeding unit, said links being coupled to said axle and adapted for moving said film/sheet of bags toward or away from said feeding unit, said brake being coupled to said axle and adapted to buffer the revolving speed of said axle in delivering said film/sheet of bags.

3. The film roll/bags-on-a-roll making machine as claimed in claim 1, wherein said first sheet-transfer cylinder of said feeding unit is selected from the group of rubber and materials with a friction coefficient.

4. The film roll/bags-on-a-roll making machine as claimed in claim 1, wherein said feeding unit further comprises a bracket and at least one drive member, said bracket being adapted to hold said first sheet-transfer cylinder and said second sheet-transfer cylinder, said at least one drive member being adapted to biasing said bracket to move said first sheet-transfer cylinder into contact with or away from one said reel in one said reel-holding device.

5. The film roll/bags-on-a-roll making machine as claimed in claim 1, wherein said second reel-holding member of each said reel-holding device of said reel displacement unit is loaded with a spring; said reel displacement unit further comprises a plurality of holder tubes equiangularly located at one said disc that holds said second reel-holding members of said reel-holding devices, each said second reel-holding member being supported on the associating said spring in one respective said holder tube and axially slidable coupled to the respective said holder tube.

6. The film roll/bags-on-a-roll making machine as claimed in claim 5, wherein said first reel-holding member and said second reel-holding member of each said reel-holding device each comprise a reel-holding end portion, the reel-holding end portions of said first reel-holding member and said second reel-holding member being smaller than the inner diameter of each said reel and respectively insertable into two opposite ends of one said reel to hold one said reel therebetween in a rotatable manner.

7. The film roll/bags-on-a-roll making machine as claimed in claim 6, wherein said second reel-holding member further comprises an adjustment block, an axial hole and a pin, said pin having one end thereof formed integral with said reel-holding end portion of said second reel-holding member and an opposite end thereof inserted through said adjustment block into the inside of said axial hole, said adjustment block comprising a radial screw hole and being axially slidably coupled to said pin between said reel-holding end portion of said second reel-holding member and the respective said holder tube and stopped at one end of the respective said spring and locked to said pin with a tightening-up screw being threaded into said radial screw hole.

8. The film roll/bags-on-a-roll making machine as claimed in claim 7, wherein said reel displacement unit comprises a reel displacement unit pneumatic cylinder, a guide yoke and a plurality of stop blocks, said stop blocks being equiangularly supported on an outer side of one said disc opposite to respective said second reel-holding members and said holder tubes and axially movable by the respective said second reel-holding members, said guide yoke being disposed between said reel let-off position and said reel-supplying position at one lateral side relative to said stop blocks, said reel displacement unit pneumatic cylinder being movable with said second reel-holding members of said reel-holding devices and said stop blocks.

9. The film roll/bags-on-a-roll making machine as claimed in claim 6, wherein said reel displacement unit comprises a reel displacement unit pneumatic cylinder, a guide yoke and a plurality of stop blocks, said stop blocks being equiangularly supported on an outer side of one said disc opposite to respective said second reel-holding members and said holder tubes and axially movable by the respective said second reel-holding members, said guide yoke being disposed between said reel let-off position and said reel-supplying position at one lateral side relative to said stop blocks, said reel displacement unit pneumatic cylinder being movable with said second reel-holding members of said reel-holding devices and said stop blocks.

10. The film roll/bags-on-a-roll making machine as claimed in claim 1, wherein said cutting device comprises a cutting device first pneumatic cylinder component, a base frame, a cutting device second pneumatic cylinder component, a serrated cutting blade, a cutter holder, a pressure cover, an air sprayer and a pressure cover pneumatic cylinder, said cutting device first pneumatic cylinder component being mounted in a bottom side of said base frame, said cutting device second pneumatic cylinder component being upwardly inserted through said base frame and coupled to said first pneumatic cylinder component at a top side, said serrated cutting blade being mounted at said cutting device second pneumatic cylinder component, said cutter holder being connected to said cutting device second pneumatic cylinder component to hold said serrated cutting blade, said air sprayer being mounted at said cutter holder and comprising a plurality of jet holes, said pressure cover defining an arched inner wall, said pressure cover pneumatic cylinder being controllable to move said pressure cover downwardly onto said film/sheet of bags on one said reel in one said reel-holding device for enabling said film/sheet of bags to be cut off by said serrated cutting blade and the cut edge of said film/sheet of bags to be forced away from said arched inner wall of said pressure cover by a compressed air being delivered out of said jet holes of said air sprayer to another said reel in another said reel-holding device.

11. The film roll/bags-on-a-roll making machine as claimed in claim 1, further comprising a smoothing unit, said smoothing unit comprising a smoothing unit pneumatic cylinder, a roller holder frame, a smoothing roller and a smoothing unit power drive, said roller holder frame being connected to said smoothing unit pneumatic cylinder, said smoothing unit power drive being coupled with said smoothing roller, said smoothing roller being rotatably mounted in said roller holder frame, said smoothing unit pneumatic cylinder being controllable to move said roller holder frame and said smoothing roller into contact with a finished film roll/bags-on-a-roll at one said reel for enabling said smoothing roller to be rotated by said smoothing unit power drive to smooth the edge of said finished film roll/bags-on-a-roll at the respective said reel.

12. The film roll/bags-on-a-roll making machine as claimed in claim 11, wherein said control unit is controllable to drive said smoothing unit power drive to rotate said smoothing roller in a direction reverse to the winding direction of said film/sheet of bags being wound round each said reel into a film roll/bags-on-a-roll.

13. The film roll/bags-on-a-roll making machine as claimed in claim 12, wherein said smoothing roller is selected from the group of rubber and materials with a friction coefficient.

14. The film roll/bags-on-a-roll making machine as claimed in claim 11, wherein said smoothing roller is selected from the group of rubber and materials with a friction coefficient.

* * * * *